US005097790A

United States Patent [19]

Massey

[11] Patent Number: 5,097,790

[45] Date of Patent: Mar. 24, 1992

[54] FLAGGER GATE FOR ROADWAY CONSTRUCTION SITES

[75] Inventor: Robert L. Massey, Independence, Mo.

[73] Assignee: Graham-Migletz Enterprises, Inc., Independence, Mo.

[21] Appl. No.: 632,050

[22] Filed: Dec. 21, 1990

[51] Int. Cl.[5] ..... E01F 13/00

[52] U.S. Cl. ..... 116/63 P; 116/303

[58] Field of Search ..... 116/63 R, 63 P, 284, 116/303; 49/9, 49; 340/908, 908.1; 40/612; 256/1, 13.1

[56] References Cited

U.S. PATENT DOCUMENTS

| | | | |
|---|---|---|---|
| 1,158,610 | 11/1915 | Whitman | 116/63 P |
| 1,234,249 | 7/1917 | Zabel | 116/63 R |
| 1,271,740 | 7/1918 | McKinney | 116/63 R |
| 1,499,906 | 7/1924 | Brenkert | 116/63 P |
| 1,628,651 | 5/1927 | Burress | 49/9 |
| 2,109,286 | 2/1938 | Cubby | 116/63 P |
| 2,137,193 | 11/1938 | Stafford | 49/247 |
| 2,749,876 | 6/1956 | Patton et al. | 116/63 R |
| 3,061,960 | 11/1962 | Dull | 116/63 P |
| 3,223,387 | 12/1965 | Magliocco | 256/1 |
| 3,380,429 | 4/1968 | Moinicken et al. | 116/63 P |
| 3,589,066 | 6/1971 | Fisher | 49/35 |
| 3,686,794 | 8/1972 | Sakamoto et al. | 49/141 |
| 3,798,592 | 3/1974 | Lilly | 340/908 |
| 3,863,214 | 1/1975 | Kerr, Jr. | 340/131 |
| 3,867,775 | 2/1975 | Lapman et al. | 116/63 R |
| 3,886,519 | 5/1975 | Hovland | 340/568 |
| 3,968,596 | 7/1976 | Danin | 49/49 |
| 4,050,401 | 9/1977 | Kelly | 116/63 P |
| 4,065,104 | 12/1977 | Pass | 256/13.1 |
| 4,434,578 | 3/1984 | Rumpz | 49/49 |
| 4,616,225 | 10/1986 | Woudenberg | 340/908 |
| 4,777,751 | 10/1988 | Pasquale | 40/612 |
| 4,844,653 | 7/1989 | Dickinson | 404/6 |

FOREIGN PATENT DOCUMENTS

| | | | |
|---|---|---|---|
| 0331964 | 1/1921 | Fed. Rep. of Germany | 116/63 R |

*Primary Examiner*—William A. Cuchlinski, Jr.
*Assistant Examiner*—W. Morris Worth
*Attorney, Agent, or Firm*—Shook, Hardy & Bacon

[57] ABSTRACT

A flagger gate for roadway construction sites. The flagger gate includes a base which pivotally mounts an elongated arm. The arm may be pivoted from a lowered position where the arm extends horizontally into a lane of the roadway to a raised position where the arm extends vertically. A first sign member is located on the arm near the free end thereof, and will typically be a stop sign. A second sign is located below the arm between the free end of the arm and the base, such that the sign extends towards the roadway when the arm is raised. A linkage is provided for rotating the signs during rotation of the arm. Specifically, the first sign faces traffic when the arm is lowered, but faces upwardly when the arm is raised. The second sign faces the base when the arm is lowered, but faces traffic when the arm is raised. This eliminates confusion as to which sign to obey.

2 Claims, 3 Drawing Sheets

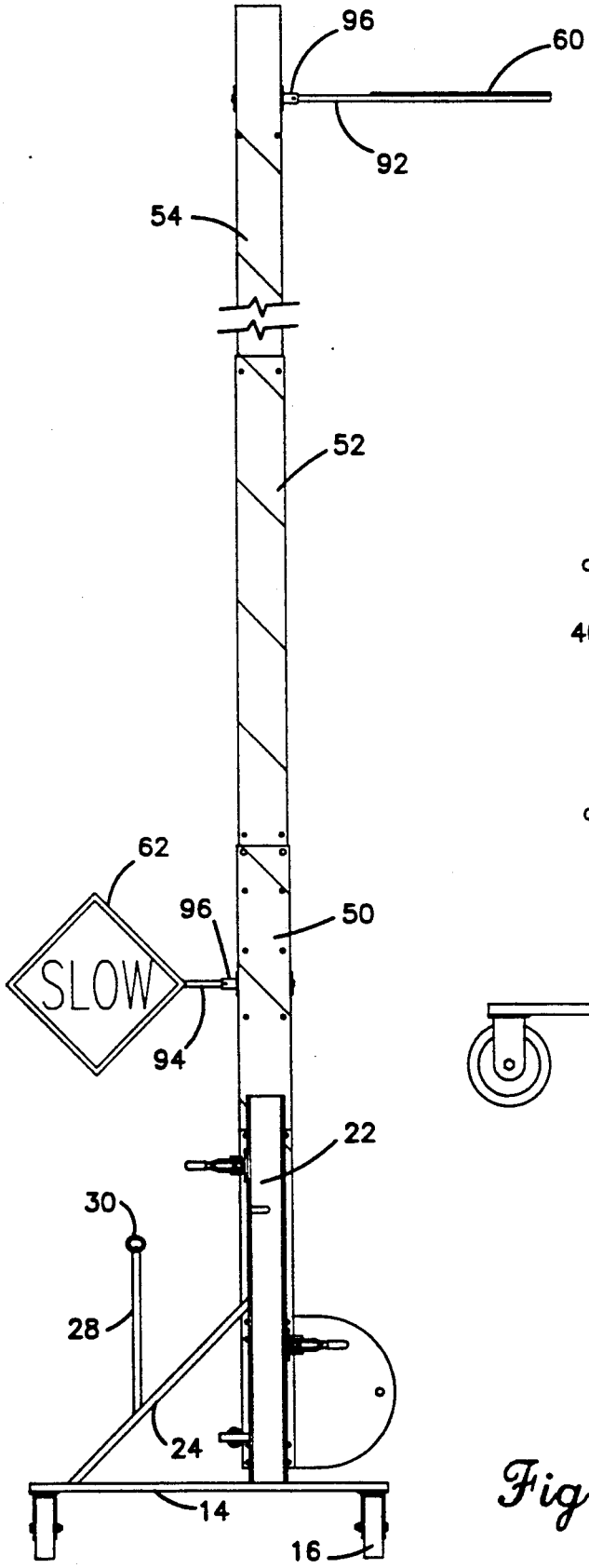
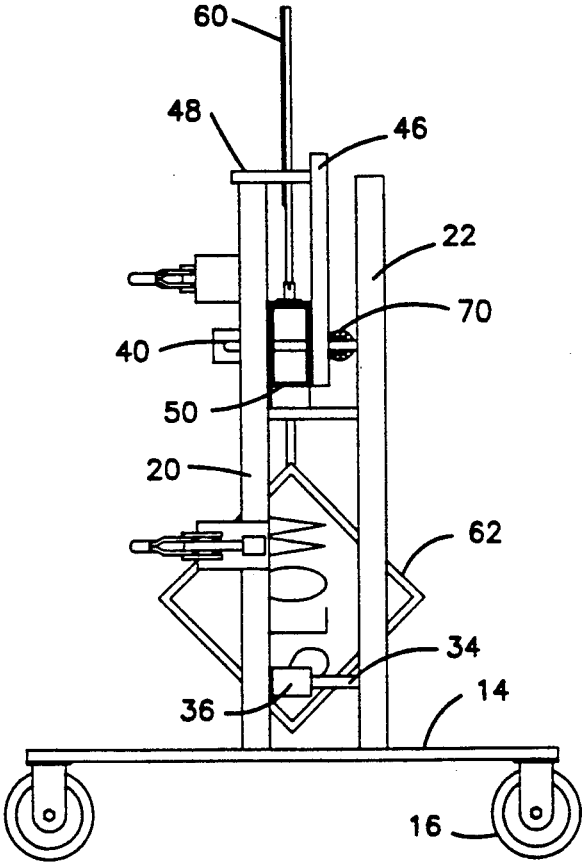
Fig. 7.
Fig. 3.

FLAGGER GATE FOR ROADWAY CONSTRUCTION SITES

BACKGROUND OF THE INVENTION

1. Field of the Invention

The present invention relates in general to vehicular traffic control. In particular, the present invention relates to an improved device for controlling the flow of vehicular traffic through a road construction site.

2. Description of the Related Art

Construction upon roadways is a common occurrence, and vehicular traffic is often allowed to pass adjacent the roadway construction site. However, it is often necessary to control this flow of traffic to allow construction vehicles to enter and exit the construction site, to alternate opposing traffic flows through a single lane, and for other reasons.

It has been known to place traffic cones or other barriers within a restricted lane of the roadway. Such barriers will, however, serve only to block the subject lane, and are impractical for allowing intermittent use of a lane of the roadway.

As such, where an intermittent flow of traffic has been desired, it has been necessary to place a worker adjacent the subject lane to act as a flagger. This individual typically carries a stop and a slow sign or a single sign having these indications on opposite sides thereof. The flagger will thus display the appropriate signal to the traffic in the subject lanes to control the flow of such traffic.

As the flagger must stand adjacent to the flow of vehicular traffic, it is apparent that the flagger is subjected to the possibility of being struck by a passing vehicle. This possibility increases during night construction, which is often necessary in areas with high volumes of traffic. The use of a human flagger therefore entails the risk of great human suffering and high medical costs.

SUMMARY OF THE INVENTION

It is therefore an object of the present invention to provide a device which will allow control of traffic flow along a roadway.

It is a further object of the present invention that this control of the traffic flow allow intermittent use of the roadway by the vehicular traffic.

Another object of the present invention is to provide a device which will allow the display of advisory information in addition to the command for the traffic flow to stop.

Yet another object of the present invention is to provide a device which will selectively and automatically display the advisory information or the command to stop.

These and other objects are achieved by a flagger gate having an elongated arm rotatably mounted to a base. The base is adapted to be positioned remote from the lane of traffic intended to be controlled. The elongated arm will extend outwardly across this lane of traffic when in a lowered position. The elongated arm may also be rotated upwardly about the base to an upright position which does not present a barrier across the subject lane, thus allowing the traffic flow to pass. The rotation of the elongated arm from the lower to the upper position may be effected by an operator standing adjacent to the base.

The flagger gate also includes indicia selectively displayed to the traffic in the subject lane. Specifically, when the elongated arm is in the lowered position a stop sign is visible to the traffic flow. Upon raising the arm to the upper position, the stop sign is rotated approximately 90° such that the command to stop is no longer visible to the traffic flow. While in the upper position, a secondary advisory sign becomes visible to the traffic flow. This advisory information may, for example, include a command to proceed slowly. As with the stop sign, when the arm is rotated from the upper position to the lower position, the secondary advisory indicia sign is rotated approximately 90° such that it is no longer visible to the traffic flow.

BRIEF DESCRIPTION OF THE DRAWINGS

The objects and features of the invention noted above are explained in more detail with reference to the drawings, in which like reference numerals denote like elements, and in which:

FIG. 3 is a front view of the device with the arm in the upright position;

FIG. 7 is a right side cross-sectional view of the device in the lowered position, taken along line 7—7 of FIG. 1.

DETAILED DESCRIPTION OF THE INVENTION

Figures 1, 6:
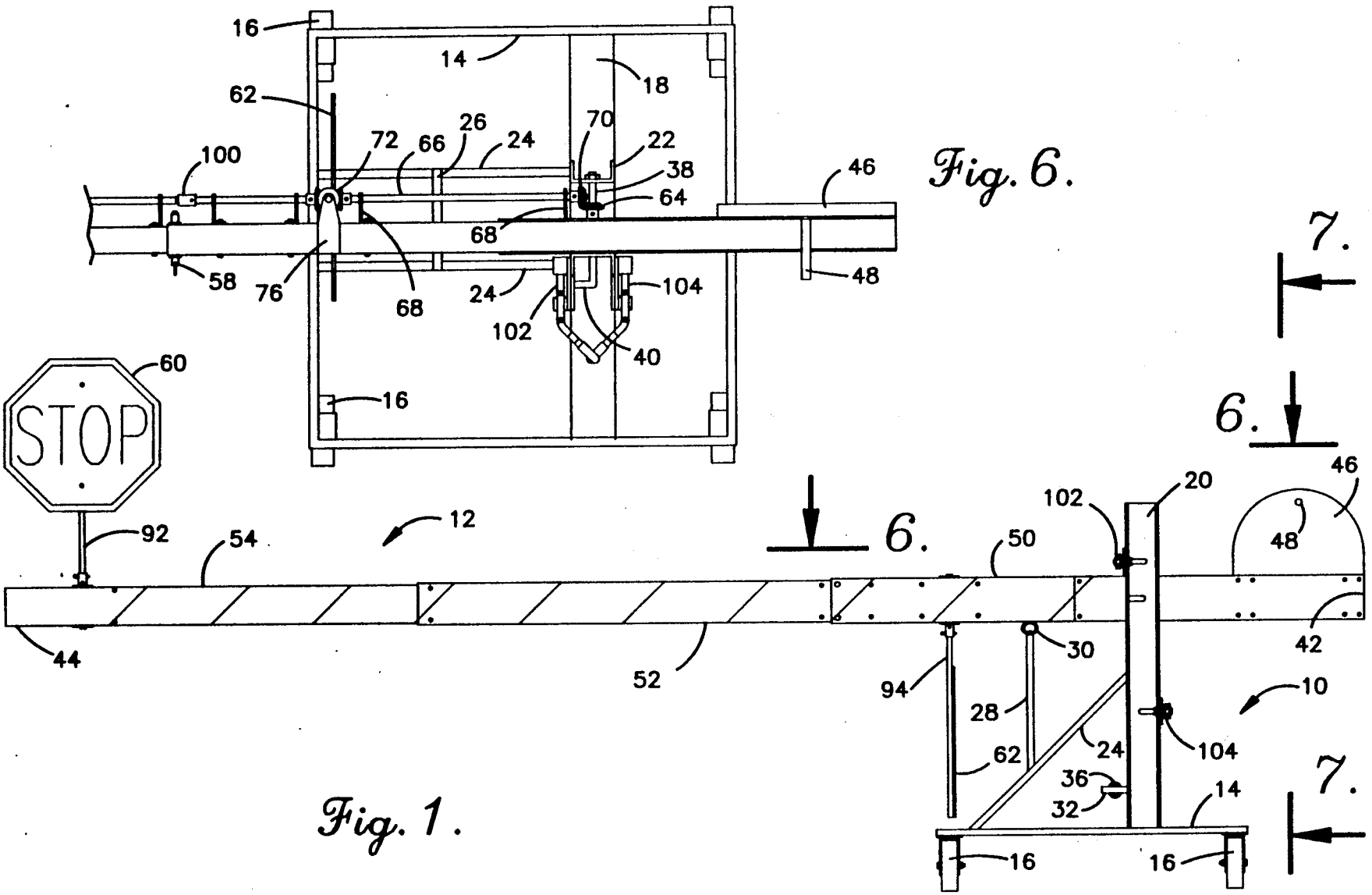
FIG. 1 is a front view of the device according to the present invention with the arm in the lowered position.
FIG. 6 is a partial top view of the device in the lowered position.
Figure 2:
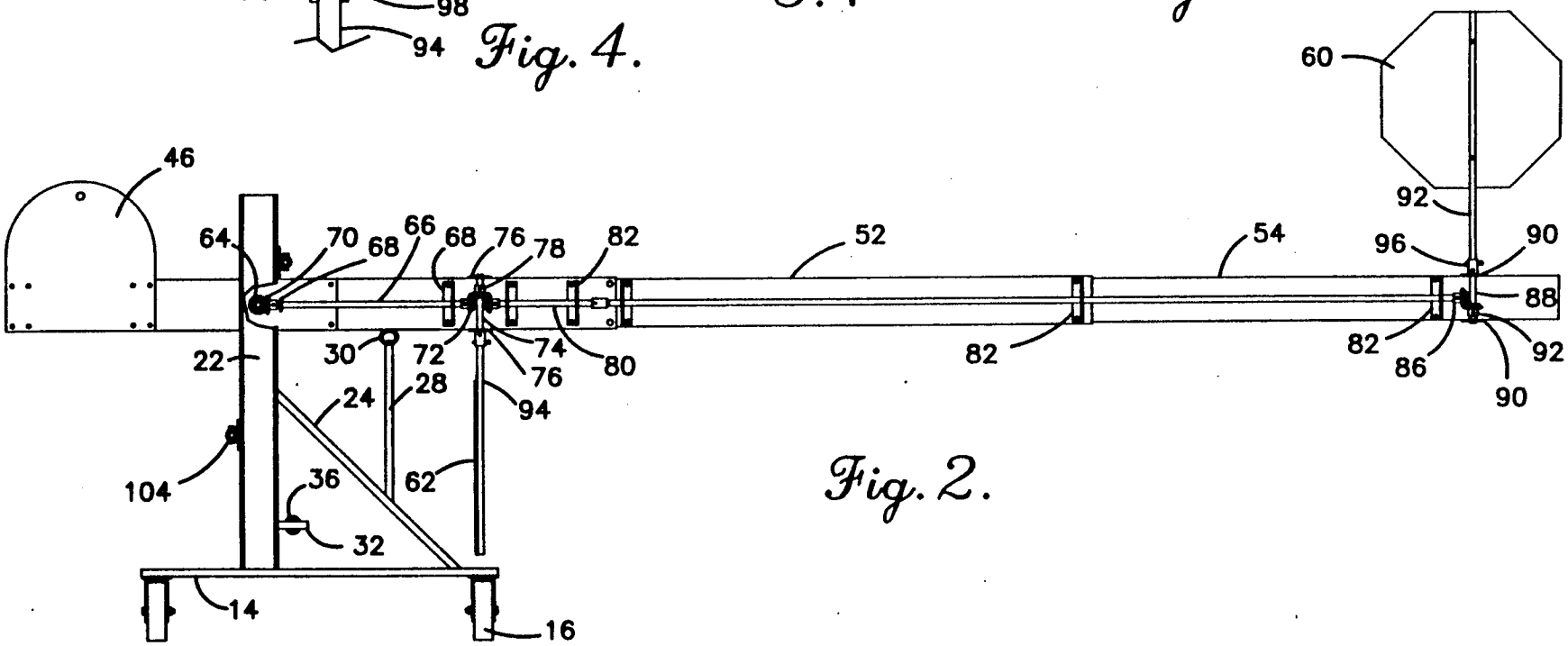
FIG. 2 is a rear view of the device with the arm in the lowered position.

With reference to FIGS. 1–3, the device according to the present invention is shown. The device includes a base 10 and an elongated arm 12. The arm 12 is shown in a lowered position in FIGS. 1 and 2 and a raised position in FIG. 3.

The base 10 includes a platform 14 which supports and stabilizes the device. As is best shown in FIG. 6, the platform may take the form of a generally rectangular framework, the plane of which is substantially parallel to the ground. A wheel 16 may be mounted at each of the corners of the platform 14 to aid in placement of the device at the desired position. Two or more of the wheels 16 may be mounted to swivel about a vertical axis to aid in positioning the device. The wheels 16 may also have locks to restrict movement of the device once it is placed in the desired position.

A support bar 18 extends across the interior of the frame !4, and is fixed thereto. The support bar is preferably offset from the center of the platform 14, for a reason discussed below. First and second pivot supports 20 and 22, respectively, extend upwardly from the support bar 18. The pivot supports may advantageously be formed of c-channels having their base portions in spaced opposed relation and their flanges extending away from each other. The pivot supports extend substantially vertically from the platform 14, and end at upper free ends.

A reinforcement bar 24, extends from a point on the associated pivot support, spaced from the support bar 18, to the side of the platform from which the support bar 18 is furthest spaced. The reinforcement bars serve to maintain the vertical upright position of the pivot supports. A cross bar 26 extends between the reinforcement bars 24 at a point spaced from each end of the support bars.

The cross bar 26 serves as a support for an abutment support 28 which is connected to, and extends vertically upwardly from, the cross bar 26. The abutment support 28 includes at its upper end a first abutment cushion 30. The first abutment cushion 30 may be conveniently formed of a short length of rubber tubing having its longitudinal axis substantially parallel to the ground and being fixed through one wall thickness only to the abutment support 28.

An abutment brace 32 is connected to each of the pivot supports 20 and 22 near the lower ends of the pivot supports, and on the side of the pivot supports which includes the reinforcement bar 24. Extending horizontally between the abutment braces 32 is an abutment bar 34. Mounted to the abutment bar 34 is a second abutment cushion 36 which may be similar to, and mounted in the same manner as, the first abutment cushion 30.

Extending between the first and second pivot supports 20 and 22 is a pivot rod 38. The pivot rod 38 is mounted above both the first and second abutment cushions 30 and 34. The pivot rod 38 extends substantially horizontally between the pivot supports, and is fixed thereto.

To ensure that the pivot rod 38 resists torsion, one end of the pivot rod 38 may include a 90° bend resulting in a shortened pivot rod extension 40 extending at a 90° angle to the longitudinal axis of the pivot rod 38. This pivot rod extension 40 may have the free end thereof fixed, as by welding, to one of the flanges of the c-channel forming one of the pivot supports. The other end of the pivot rod 38 may be threaded and include a nut to fix this end of the pivot rod to the remaining pivot support. In addition, the pivot rod 38 could be welded at the points where it crosses through the base of the c-channels forming the pivot supports 20 and 22.

Figure 5:
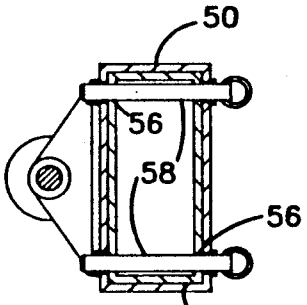
FIG. 5 is a cross-sectional view taken along line 5—5 in FIG. 4.

The pivot rod 38 forms the pivot for the elongated arm 12. As is best shown in FIGS. 5 and 7, the elongated arm 12 preferably has the form of a box channel, although other cross-sectional configurations are possible. Since the elongated arm 12 rotates about the pivot rod 38, a bearing or bearings may be interposed between the elongated arm 12 and pivot rod 38.

Elongated arm 12 includes a first end 42 and a second end 44. The elongated arm 12 is situated such that the pivot rod 38 extends through the arm 12 much closer to first end 42 than second end 44. As such, the second end 44 of the elongated arm extends outwardly from the base 10 a much greater distance than the first end 42. To balance, or at least partially balance, the arm 12 on the pivot rod 38, a balance weight 46 is connected to the elongated arm 12 at the first end 42 thereof. The balance weight 46 may include a handle 48 extending horizontally outwardly therefrom. The purpose of handle 48 will be discussed in detail below. The offset placement of the support bar 18, noted above, helps to prevent tipping of the device when the arm 12 is in the lowered position.

To decrease the weight of the entire device, and thus increase its portability, the elongated arm 12 may be tapered between the pivot rod 38 and second end 44. This will reduce the weight of the elongated arm 12 itself, and also reduce the required weight of balance weight 46.

To effect this tapering, and additionally ease the manufacturing of the device, the elongated arm 12 may be formed of plural sections having successively reduced peripheries which are attached end to end. For example, the elongated arm 12 may be comprised of a pivot section 50 which includes the first end 42 and which receives the pivot rod 38.

An intermediate section 52 may be assembled to the pivot section 50 by forming the intermediate section 52 with an outer periphery corresponding in size and shape to the inner periphery of the pivot section 50. In a similar manner, the elongated arm 12 may be completed by a free end section 54 having an outer periphery which corresponds in shape and size to the inner periphery of the intermediate section 52. In this manner, the sections may be manufactured individually to reduce costs, and will additionally provide the desired taper in the elongated arm 12.

The materials employed to form the elongated arm 12 may also have a major effect upon the weight thereof. While lightweight steel alloys or aluminum may be used and provide desirable strength, fiberglass, carbon fibers or other materials may also provide the required strength and light weight. Where composite materials are used, a metal plate may be connected to the vertical sides of the arm in the area extending between the pivot rod 38 an balance weight 46 for reinforcement. This is shown in the figures.

In addition to reducing the weight of the device, the portability may be improved by allowing partial disassembly of the device to reduce its overall size. An arrangement allowing partial disassembly of the device is shown in FIGS. 4–6.

It has been found advantageous to allow disassembly of at least on of the joints between the sections comprising the elongated arm 12. As shown in FIG. 4, and as described above, the intermediate section 52 is received within the pivot section 50 a specified distance. This distance should allow sufficient weight distribution along the area of overlap of the two sections to prevent undue forces, but should not be so large as to increase the overall weight of the device more than is necessary. This nested arrangement of the sections 50 and 52 is also shown in cross section in FIG. 5.

Figure 4:
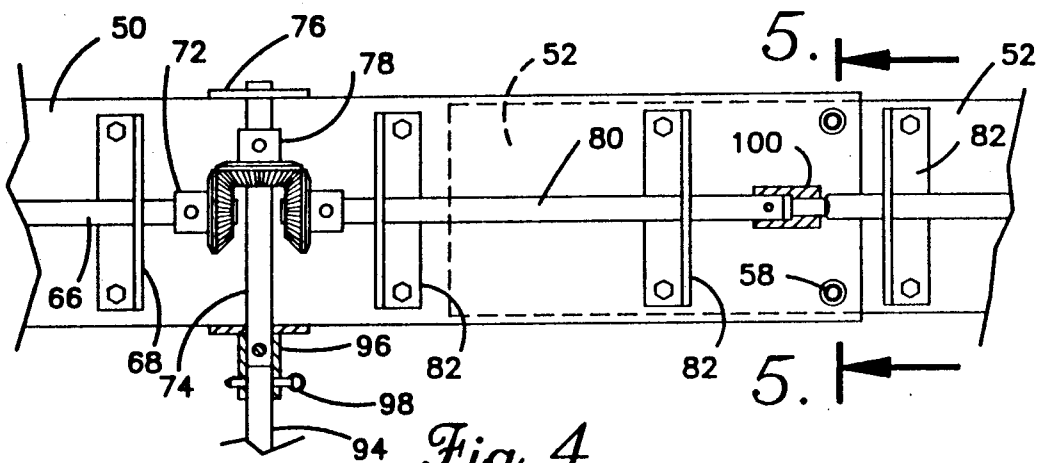
FIG. 4 is a fragmentary detail view of the linkage controlling the advisory signs.

As may be seen from FIGS. 4–6, a pair of through holes 56 extend completely through each of the sections in the horizontal direction. As shown in FIG. 5, a bushing may be applied to the through holes 56 of the larger periphery section. In addition, a bushing could also be applied to the smaller diameter interior section. Such bushings may be particularly advantageous where the sections forming the elongated arm are formed of a composite material, rather than a metal.

A section pin 58 may be inserted through each of the through holes 56 to fix the associated sections in their assembled configuration. The use of pins 58 having ball detents on one end and pull rings on the other will allow the pins 58 to be inserted and removed without the use of tools. Alternatively, a nut and bolt may be substituted for each of the section pins 58, or entirely different means for holding the associated sections in their assembled position may be used.

While the releasable connection between the sections has been described only with regard to pivot section 50 and intermediate section 52, it is to be understood that such a connection may also be formed between the intermediate section 52 and free end section 54.

The device according to the present invention also includes first and second sign members 60 and 62, respectively, which are employed to provide information or commands to the traffic to be controlled. As may be seen by a comparison of FIGS. 1 and 3, first sign member 60 is employed to issue the appropriate command when the elongated arm 12 is in the lowered horizontal position (FIG. 1), and second sign member 62 is used to issue the appropriate command when the elongated arm 12 is in the raised position (FIG. 3).

As the elongated arm 12 is intended in most circumstances to stretch at least partially across the lane of the roadway in which traffic is to be controlled when in the lowered horizontal position, first sign member 60 will typically take the form of a standard stop sign. To insure that this first sign member 60 is noticed by the oncoming traffic, the first sign member will extend upwardly from the elongated arm 12 near the second end 44 thereof. As such, first sign member 60 will be at a position easily and readily viewed by the drivers of vehicles in the subject lane.

In a similar manner, since the second sign member 62 is intended to issue the appropriate advisory when the elongated arm 12 is in the raised position, the second sign member 62 extends outwardly from the elongated arm 12 in a direction opposite to that of first sign member 60. Specifically, when the elongated arm is in the lowered position of FIG. 1 the first sign member 60 will extend upwardly from the elongated arm while the second sign member 62 extends downwardly from the elongated arm. The second sign member 62 preferably extends from the elongated arm at a point therealong such that when the arm is in the raised position, the second sign member 62 has a vertical height similar to that of first sign member 60, to ensure that the second sign member 62 is noticed. This will necessarily require that the second sign member be spaced from the pivot rod 38 a distance less than that from which the first sign member 60 is spaced from the pivot rod 38.

To reduce confusion as to which of the sign members is to be obeyed, it is preferred that the device include means for rotating each of the sign members between an operative and an inoperative position.

A linkage mechanism allowing this rotation of the sign members is best shown in FIGS. 2, 4 and 6. As is best shown in FIGS. 2 and 6, the pivot rod 38 includes a main bevel gear 64 fixed thereto. The main bevel gear 64 may be fixed by any known means, for example, a set screw or a slot and key.

A primary follower rod 66 is rotatably mounted along the longitudinal axis of the elongated arm 12 by a plurality of first rod guides 68. The rod guides 68 allow the primary follower rod 66 to rotate about an axis substantially parallel to the longitudinal axis of the elongated arm 12, but substantially restrict translation along this longitudinal axis. A first end of the primary follower rod 66, which is closest to the pivot rod 38, includes a first follower gear 70. First follower gear 70 is a bevel gear which is in meshing engagement with main bevel gear 64. The second end of the primary follower rod 66 also includes a secondary follower gear 72 attached thereto. The secondary follower gear 72 is located proximate the point desired for the location of secondary sign member 62.

A secondary sign take off rod 74 is mounted to the elongated arm 12 to be substantially perpendicular to the primary follower rod 66, such that the secondary sign takeoff rod 74 is substantially vertical when the elongated arm is in the lowered position of FIG. 2. The secondary takeoff rod 74 is mounted to the elongated arm with a pair of secondary sign rod guides 76 which allow rotation about the longitudinal axis of takeoff rod 74, but substantially prevent translation along this axis. The secondary sign takeoff rod 74 also includes a beveled secondary takeoff gear 78 fixed thereon and in meshing engagement with secondary follower gear 72.

A secondary follower rod 80 is mounted to the elongated arm 12 to extend substantially between the position for secondary sign member 62 and first sign member 60. The longitudinal axis of the secondary follower rod 80 is substantially aligned with the longitudinal axis of primary follower rod 66. As with the primary follower rod 66, the secondary follower rod 80 includes a plurality of secondary rod guides 82 mounting the follower rod 80 to the arm 12, and which allow rotation about the longitudinal axis of the rod, but substantially prevent translation therealong.

A first end of the secondary follower rod 80, which is closest to the pivot rod 38, includes a third follower gear fixed thereon. Third follower gear 84 is a bevel gear and is in meshing engagement with the secondary takeoff gear 78 and is in opposed relation to secondary follower gear 72. A second end of the secondary follower rod 80 includes a fourth follower gear 86 fixed thereto. This fourth follower gear 86 is a bevel gear and is located proximate the point desired for the location of first sign member 60.

In a manner similar to the second sign takeoff rod 74 discussed above, a first sign takeoff rod 88 is mounted to the arm 12 adjacent the second end of the secondary follower rod 80. The first sign takeoff rod 88 extends substantially perpendicular to the follower rod 80, such that it stands substantially vertical when the arm 12 is in the lowered position. First sign takeoff rod 88 is mounted to the arm 12 by a pair of first sign rod guides 90 which allow rotation of the takeoff rod 88 about its longitudinal axis, but substantially prevent translation along this axis. The first sign takeoff rod 88 also includes a first takeoff gear 92 fixed thereon and in meshing engagement with the fourth follower gear 86.

Since the main bevel gear 64 is fixed to the stationary pivot rod 38, it may be readily seen that rotation of the elongated arm 12 about the pivot rod 38 will cause the first follower gear 70 to rotate about the longitudinal axis of the primary follower rod 66. As the first follower gear 70, and the other follower gears, are fixed to their associated rods, the rotation of first follower gear 70 will in turn cause rotation of the remaining gears and rods. Therefore, by connecting the first sign member 60 to the first sign takeoff rod 88, and connecting the second sign member 62 to the second sign takeoff rod 74, the first and second sign members will be rotated between their operative and inoperative positions during the rotation of the elongated arm 12 about the pivot rod 38.

It is preferred that the gearing is designed such that the first and second sign members rotate approximately 90° during the movement of the elongated arm 12 between the raised and lowered positions. This will result in one of the sign members fully facing the oncoming traffic while the other sign member presents a minimum side profile to the oncoming traffic during either position of the arm 12.. This will reduce confusion as to which of the signs are to be obeyed.

To further reduce the possible confusion of conflicting commands given to the oncoming traffic, it is preferred that each of the sign members include the indicia upon a single face thereof. As such, the rear face of each of the sign members will be essentially blank.

To take advantage of such one-sided sign members, it is preferred that the sign members rotate in a specific manner during movement of the elongated arm from the raised and lowered positions. In particular, it is preferred that the second sign member 62 be oriented with the indicia-containing face facing the pivot rod 38 when the elongated arm 12 is in the lowered position. This will cause the blank face of the second sign member to face towards the free second end 44 of the elongated arm 12. Drivers of vehicles in the subject lane, who will be near the second free end of elongated arm 12 will therefore see only the profile of the second sign member 62, or a portion of the blank face of this sign member.

It is also preferred that the first sign member 60 rotates such that the indicia bearing face is facing upwards when the elongated arm 12 is in the raised position. This will result in the blank face of the first sign member 60 facing downwardly towards the roadway. As such, a driver of a vehicle in the subject lane, looking up towards the upper end of the raised elongated arm would view only a profile of the first sign member 60, or a portion of the blank face of this sign member.

The gearing shown in the figures and described above will affect this desired motion of the sign members. It should be noted of course that other gearing arrangements could also provide this desired motion. Various other mechanisms, such as belts and pulleys, could also effect the desired motion of the sign members, and as such may be used in place of the described gearing.

It is also noted that appropriate bearings may be used on the various rods to improve their rotation and insure smooth operation.

To further improve the portability of the device, the first and second sign members may be removable from their associated takeoff rods. Specifically, each of the takeoff rods may extend outwardly from the arm 12 by a sufficient distance to provide a coupling with a first support rod 92 fixed to the first sign member 60 or the second support rod 94 fixed to the second sign member 62. This coupling may be advantageously provided by a coupling member 96 connected to each of the takeoff rods 74 and 88. The coupling members and support rods 92 and 94 may include matching holes such that the support rods may be fixed to the coupling members by use of a pin having a ball detent and a pull ring after pin insert 98.

While this arrangement increases mobility of the device by reducing its overall size, this also provides the important advantage of being able to modify the indicia displayed by the device. While the first sign member would typically be formed only as a standard stop sign, the second sign member 62 may convey a message appropriate to the given circumstance, for example, the command to slow or not to pass.

In those cases where the portability of the device has been improved by forming the elongated arm as plural segments, it is clear that the follower rods must be similarly segmented. As shown in FIGS. 2 and 4, this may be accomplished by forming the secondary follower rod 80 as a plurality of rods with couplers 100 allowing connection and disconnection of these rods. As above, while only one coupler 100 has been shown, a further coupler could of course be provided for the intersection of each of the segments forming the elongated arm 12.

It is also noted that the various gears and rods have been shown as fully exposed in the figures. While this allows easy servicing and access to the couplers 100, the environment adjacent to a construction site may dictate that portions of the mechanism, particularly the meshed gears, include a removable cover to reduce contamination of the mechanism by dust and other debris.

In operation, the device is transported to the construction site and the base 10 placed in the approximate position for the device. The elongated arm 12 is then assembled by sliding the associated segments together and inserting the appropriate section ends 58. During this operation the couplers 100 are also employed to connect the various pieces of the secondary follower rod 80. After having chosen the appropriate command signs, the first and second sign members are connected to the elongated arm by inserting the support rods 92 and 94 into the respective coupling members 96 and securing the same with the pins 98.

At this point the final positioning of the device is effected such that the elongated arm, when in the lowered position, blocks the subject lane of traffic to the desired degree. The locks for the wheels 16 may then be activated.

To halt the flow of traffic, the operator merely allows the device to remain with the elongated arm 12 in the lowered position. The arm 12 will rest upon the first abutment cushion 30, and as such no operator intervention is required to maintain this position. It is also noted that in this position the first sign member 60 is visible and active while the second sign member 62 may be seen by the oncoming traffic only in profile and is thus inactive.

To allow the flow of traffic to pass through the subject lane, the operator grasps the handle 48 and pushes downwardly thereon. Assisted by the balance weight 46, the operator continues pushing on the handle 48 until the elongated arm 12 rotates about the pivot rod 38 to the upper position shown in FIG. 3. When the elongated arm 12 has reached the upper position, the second end 42 of the elongated arm 12 will abut against the second abutment cushion 36, thus stopping the pivotal movement of the elongated arm 12. Due to the gear and rod mechanism, the first sign member 60 will have rotated from the operative position facing the oncoming traffic to a profile condition, and is thus inactive. Similarly, the second sign member 6 will have rotated from the inactive profiled position of FIG. 1 to the operative position of FIG. 3 facing the oncoming traffic. As may be seen from FIG. 3, while second sign member 62 faces the traffic in the operative position, it is essentially within the confines of platform 14 and as such there is little risk of the oncoming traffic striking the second sign member 62.

The second abutment cushion may be placed such that the center of gravity of the elongated arm when in the upper position is on the opposite side of the pivot rod 38 from the second abutment cushion 34. This will result in the elongated arm !2 staying in the upright position against the force of the second abutment cushion 34 without operator intervention. However, to improve the safety of the device, it is preferred if appropriate locks are provided to fix the elongated arm in the upper position of FIG. 3.

First and second locking means 102 and 104, respectively, are mounted on the first pivot support 20. As shown in the Figures, each of the locking means comprises a bar slidable within a guide and having a handle attached to a linkage to move the sliding bar between a locked and an unlocked position. One of the locking means is mounted on each of the flanges of the c-channel forming the first pivot support 20. As such, when the locking means 102 and 104 are moved to the locking position the sliding bars of the locking means will extend into the path of rotation of the elongated arm 12, thus preventing the elongated ar 12 from moving from the upper to the lowered position.

While the locking means have been described as sliding bars with actuating linkages, other arrangements could, of course, be employed.

It should be noted that various modifications may be made to the device in view of particular circumstances. For example, while two sign members have been shown, further sign members could of course be included, with appropriate takeoff rods and gearing. The device may also include features to comply with appropriate state and federal requirements. For example, the elongated arm 12 may include broad diagonal stripes of alternating white and red reflective material or paint. The arm could also include a weakened portion such that the arm will break away if struck by a vehicle. Appropriate lights could also be included on the base, arm or the sign members. These lights could be selectively activated in response to the position of the arm, and could be controlled by appropriate switches, for example mercury switches. Such modifications are, of course, considered to be within the scope of the present invention.

Additionally, while the operation of the device was described as manual, appropriate actuators, such as hydraulic cylinders, and control means could be provided such that the operator need merely throw a control switch to raise and lower the arm 12. The control switch could also a wireless remote control unit to allow the operator to remain even further away from the traffic flow.

From the foregoing it will be seen that this invention is on well adapted to attain all ends and objects hereinabove set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A flagger gate for traffic control at a roadway, comprising:

a base adapted to be located adjacent the roadway;

an elongated arm having first and second ends, said arm being pivotally mounted to said base at a point closer to said first end than said second end for rotation between a lowered position where said arm extends substantially parallel to the ground and is adapted to extend at least partially across the roadway, and a raised position where said arm extends substantially normal to the ground and is adapted to be at least substantially removed from the roadway;

at least one first sign member rotatively mounted on said arm at a position closer to said second end than to said first end, said first sign member including indicia relating to traffic control thereon;

at least one second sign member rotatively mounted on said arm at a position between said first sign member and said pivotal connection to said base, said second sign member including indicia relating to traffic control thereon; and means for rotating said sign members in response to rotation of said arm, said first sign member moving from a first highly visible position when said arm is in said lowered position to a second poorly visible position when said arm is in said raised position, and said second sign member moving from a first poorly visible position when said arm is in said lowered position to a second highly visible position when said arm is in said raised position, wherein said means for moving said sign members comprises:

a main bevel gear fixed with respect to said base at said pivotal connection between said base and said arm;

a primary follower rod rotatably mounted on said arm substantially parallel to the longitudinal axis thereof, said follower rod having a follower bevel gear fixed at each end thereof, a first one of said follower gears being in meshing engagement with said main bevel gear;

a secondary takeoff rod rotatively mounted on said arm substantially perpendicular to the longitudinal axis thereof, said takeoff rod having a secondary takeoff gear fixed thereto and in meshing engagement with a second one of said follower gears, said second sign member being coupled with said secondary takeoff rod;

a secondary follower rod rotatably mounted on said arm substantially parallel to the longitudinal axis thereof, said secondary follower rod having a third and a fourth follower bevel gear fixed at respective ends thereof, said third follower gear being in meshing engagement with said secondary takeoff gear; and a primary takeoff rod rotatably mounted on said arm substantially perpendicular to the longitudinal axis thereof, said primary takeoff rod having a primary takeoff gear fixed thereto and in meshing engagement with said fourth follower gear, said first sign member being coupled with said primary takeoff rod.

2. A flagger gate for traffic control at a roadway construction site, comprising:

a base adapted to be located adjacent a lane of the roadway;

an elongated arm having first and second ends, said arm being pivotally mounted to said base at a point closer to said first end for rotation between a lowered position where said arm extends substantially parallel to the ground and is adapted to extend at least partially into the lane, and a raised position where said arm extends substantially normal to the ground and is adapted to be at least substantially removed from the lane, said arm being comprises of a plurality of elongated segments coupled together end-to-end and having a substantially common longitudinal axis, at least one of said couplings between said segments being a releasable coupling;

at least one first sign member rotatively mounted on said arm at a position closer to said second end than to said first end, said first sign member including indicia relating to traffic control thereon;

at least one second sign member rotatively mounted on said arm at a position between said first sign member and said pivotal connection to said base, said second sign member including indicia relating to traffic control thereon; and means for rotating said sign members in response to rotation of said arm, said first sign member moving from a first highly visibly position when said arm is in said lowered position to a second poorly visible position when said arm is in said raised position, and said second sign member moving from a first poorly visibly position when said arm is in said lowered position to a second highly visible position when said arm is in said raised position, wherein each of said sign members is substantially planar to define front and rear faces and said indicia is located upon said front faces, and wherein said planes of said sign members are substantially normal to the axis of rotation of said arm with said front faces facing a direction when said sign members are in said highly visible positions, said plane of said first sign member is substantially normal to the longitudinal axis of said arm with said rear face facing said pivotal connection of said base and arm when said first sign is in said second poorly visible position, and said plane of said second sign member is substantially normal to the longitudinal axis of said arm with said front face facing said pivotal connection of said base and arm when said second sign is in said first poorly visible position, and wherein said means for moving said sign members comprises:

a main bevel gear fixed to said base at said pivotal connection between said base and said arm;

a primary follower rod rotatably mounted on said arm substantially parallel to the longitudinal axis thereof, said follower rod having a follower bevel gear fixed at each end thereof, a first one of said follower gears being in meshing engagement with said main bevel gear;

a secondary takeoff rod rotatably mounted on said arm substantially perpendicular to the longitudinal axis thereof, said takeoff rod having a secondary takeoff gear fixed thereto and in meshing engagement with a second one of said follower gears, said second sign member being coupled with said secondary takeoff rod;

a secondary follower rod rotatably mounted on said arm substantially parallel to the longitudinal axis thereof, said secondary follower rod having a third and a fourth follower bevel gear fixed at respective ends thereof, said third follower gear being in meshing engagement with said secondary takeoff gear; and a primary takeoff rod rotatably mounted on said arm substantially perpendicular to the longitudinal axis thereof, said primary takeoff rod having a primary takeoff gear fixed thereto and in meshing engagement with said fourth follower gear, said first sign member being coupled with said primary takeoff rod.

* * * * *